US006178666B1

(12) United States Patent
Kiniry et al.

(10) Patent No.: US 6,178,666 B1
(45) Date of Patent: Jan. 30, 2001

(54) MOLDED SNOWSHOE

(75) Inventors: Daniel P. Kiniry, Stowe, VT (US); Francis E. Mahoney, Goffstown, NH (US)

(73) Assignee: Tubbs Snowshoe Company, LLC, Stowe, VT (US)

( * ) Notice: Under 35 U.S.C. 154(b), the term of this patent shall be extended for 0 days.

(21) Appl. No.: 09/415,244

(22) Filed: Oct. 12, 1999

(51) Int. Cl.[7] ..... A43B 5/04
(52) U.S. Cl. ..... 36/125; 36/124
(58) Field of Search ..... 36/122, 123, 124, 36/125

(56) References Cited

U.S. PATENT DOCUMENTS 3,638,333 * 2/1972 Sprandel ..... 36/125
3,802,100 * 4/1974 Prater ..... 36/124
4,604,817 * 8/1986 Ramboz ..... 36/125
5,014,450 * 5/1991 McGrath ..... 36/122
5,517,773 * 5/1996 Forrest et al. ..... 36/122
6,003,249 * 12/1999 Watson ..... 36/122

* cited by examiner

*Primary Examiner*—Paul T. Sewell
*Assistant Examiner*—Troy Arnold
(74) *Attorney, Agent, or Firm*—Ross, Ross & Flavin

(57) ABSTRACT

A snowshoe has an integral deck and frame molded from a high impact, plastic material, the frame having integral molded hubs for accepting a unique binding pivot system which includes a molded two piece axle with integral bearings journalled in the molded hubs of the frame, the axle being located in close proximity to the operating plane between the snowshoe and the snow, a non-slip, easy-to-adjust binding, and a steel crampon having teeth with rounded edges which diminishes the risk of children being cut by sharp, pointed teeth.

2 Claims, 5 Drawing Sheets

MOLDED SNOWSHOE

BACKGROUND OF THE INVENTION

1. Field of the Invention

The invention relates to a molded snowshoe having an integral deck and frame.

2. Description of Related Art

Snowshoes of the prior art usually have a frame formed from metal or wood with a separate deck attached to the frame as by webbing or the like, complicated bindings for securing the snowshoes to a user's boots, and crampons with sharp, pointed teeth.

The manufacture of such snowshoes is time consuming and expensive and the end product is not always reliable in its use in that they provide inadequate traction, the bindings tend to become loose from the user's boots, and the sharp teeth of the crampon can be dangerous, especially for children.

The design challenge of molding lightweight, rigid molded shoes, usually results in designs with a domed cross section. This design strategy requires that the boot mounting surface be positioned some distance above the plane of the contact between the snowshoe and the snow. This factor creates a condition of diminishing control (less stability), and a tendency to require more walking energy. When walking on snow, especially in downhill situations, there is an angular variation as the foot is placed. If the foot is placed above the operating surface, there is also an offset which must be absorbed by leg muscles.

BRIEF SUMMARY OF THE INVENTION

The molded snowshoe of the invention comprises an integral deck and frame molded from a high impact, plastic material, the frame having integral molded hubs for accepting a unique binding pivot system which includes a molded two piece axle with integral bearings journalled in the molded hubs of the frame and located in close proximity to the operating plane between the snowshoe and the snow, a non-slip, easy-to-adjust binding, and a steel crampon having teeth with rounded edges which diminishes the risk of children being cut by sharp, pointed teeth.

DETAILED DESCRIPTION OF THE INVENTION

Figure 1:
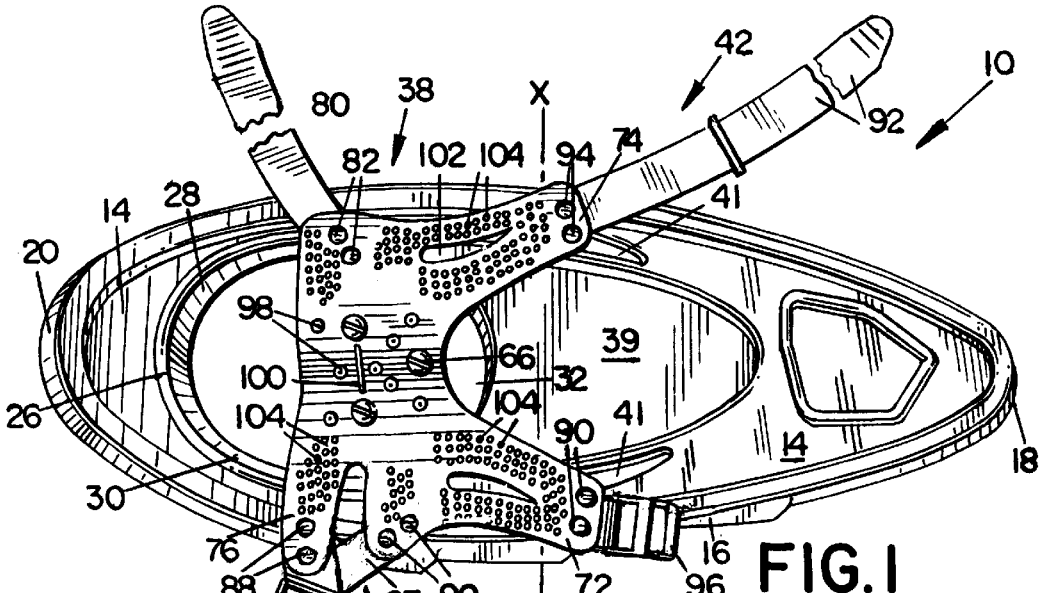
FIG. 1 is a top perspective view of a Molded Snowshoe embodying our invention, the binding shown being for the left foot of the user, the binding for the right foot being asymmetrically identical.
Figure 2:
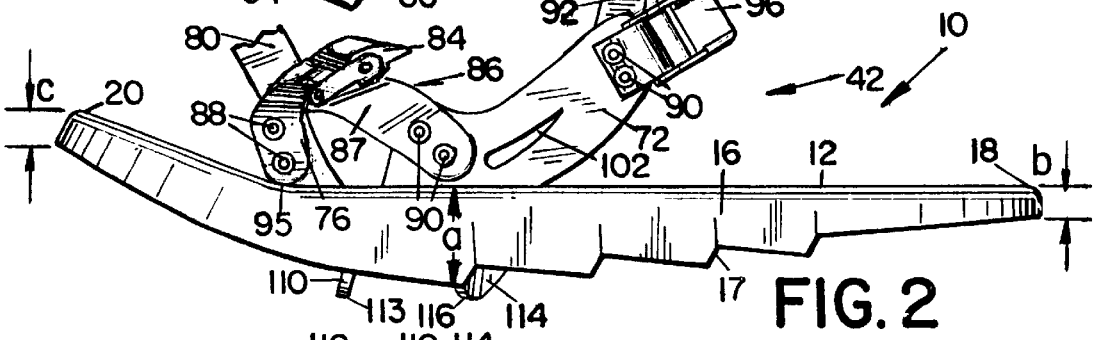
FIG. 2 is front elevational view of the Molded Snowshoe of FIG. 1.
Figure 3:
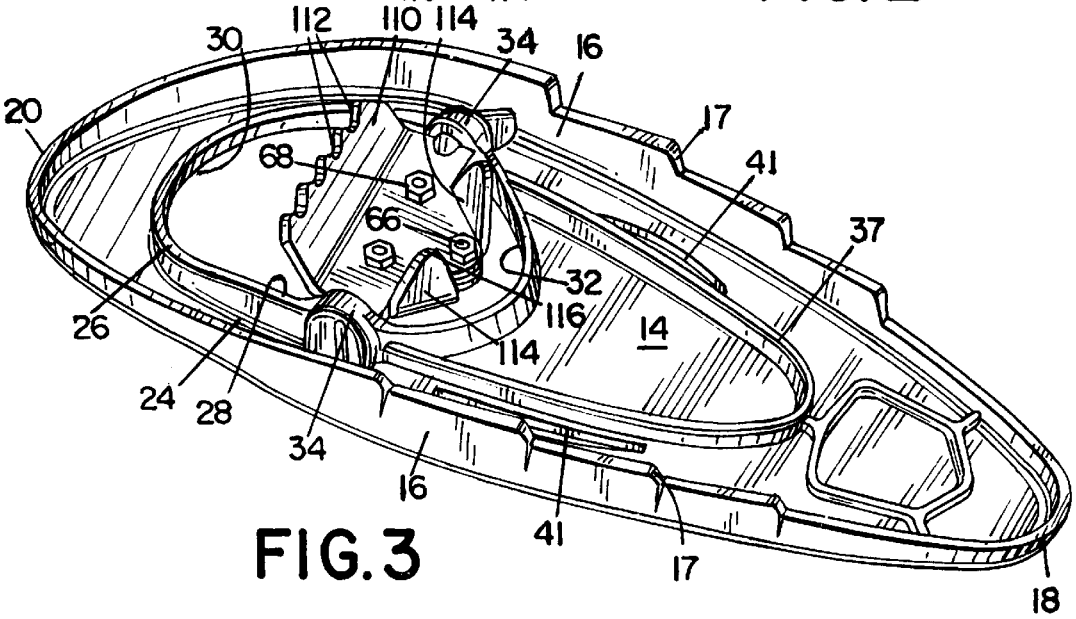
FIG. 3 is a bottom perspective view thereof with the binding omitted.
Figure 4:
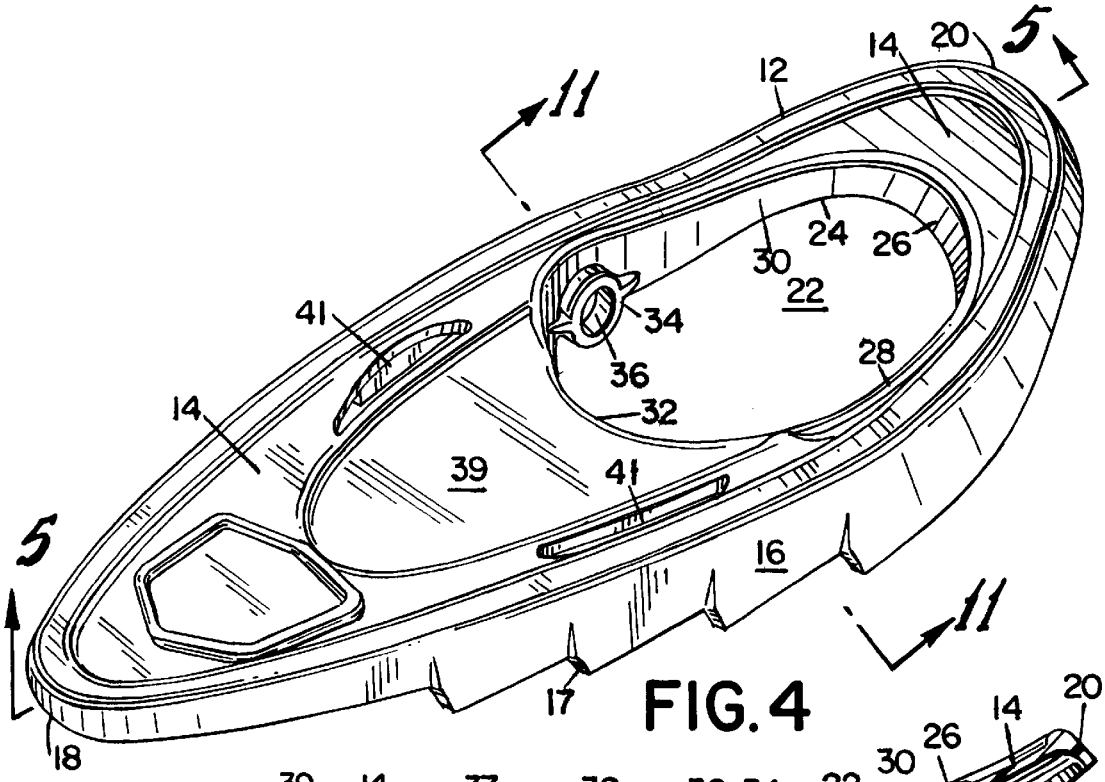
FIG. 4 is a top perspective view thereof with the binding, axle, and crampon omitted.
Figure 5:
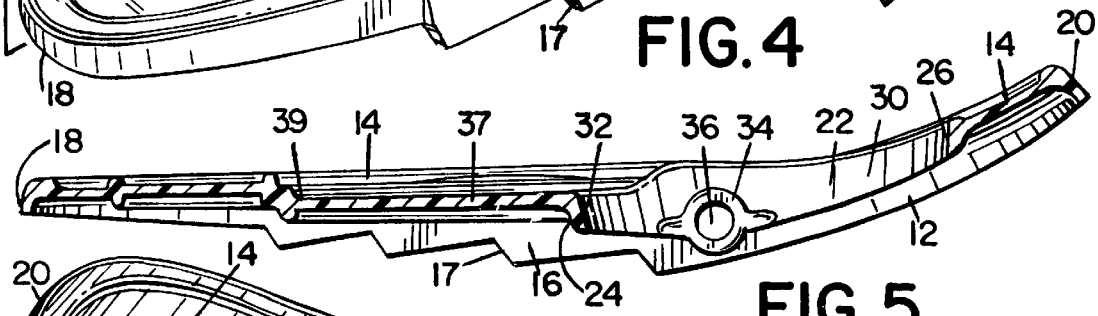
FIG. 5 is a cross sectional view taken on line 5—5 of FIG. 4.
Figure 6:
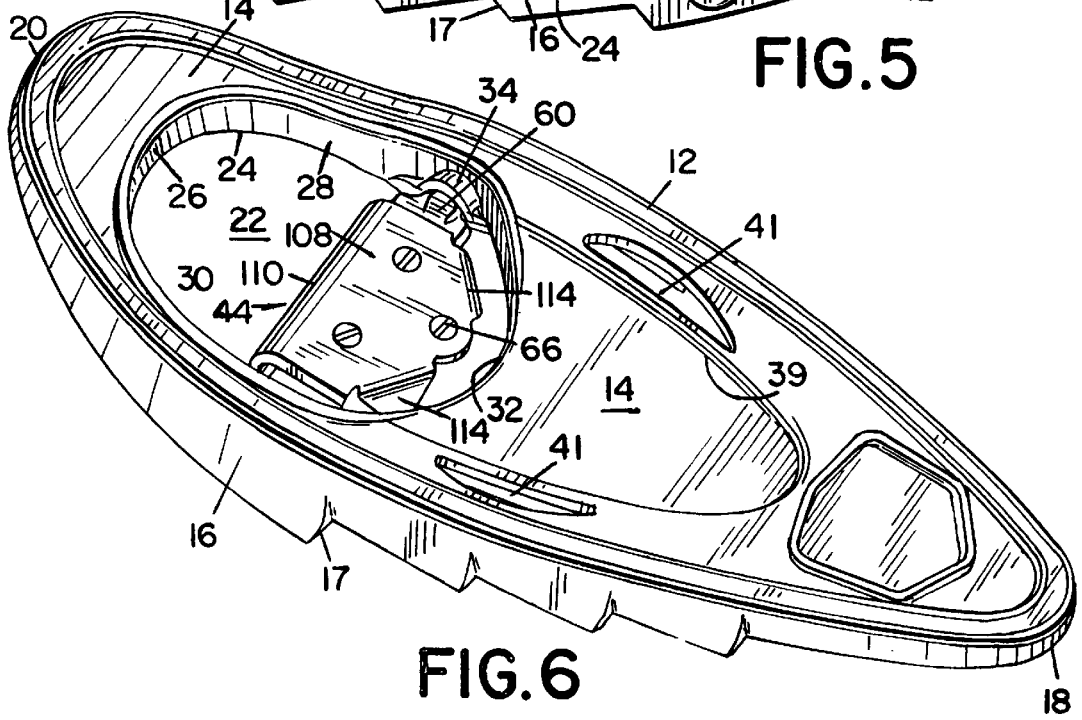
FIG. 6 is a top perspective view with the binding omitted.
Figure 7:
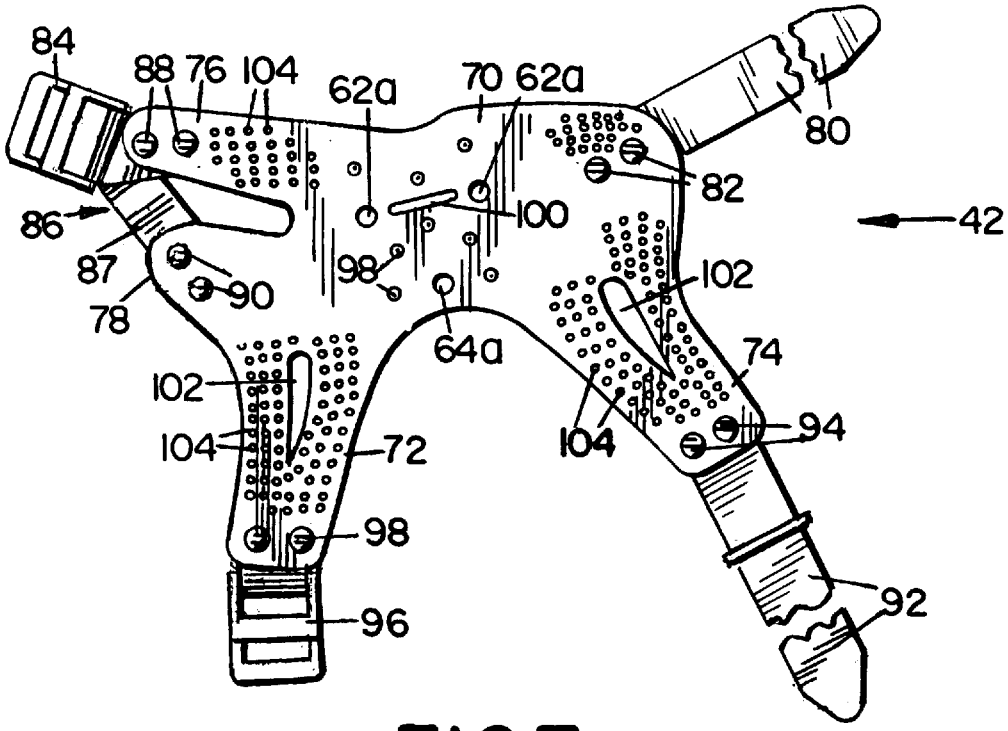
FIG. 7 is a top plan view of the left foot snowshoe binding of FIG. 1.

A snowshoe embodying our invention is generally indicated by 10 and includes a frame 12 of conventional, somewhat eliptical snowshoe shape and an integral deck 14, the frame and deck being molded as a unit having multiple levels from any strong, high impact plastic material such as thermosetting, polyurethane elastomer.

Frame 12, with its integral deck 14, includes a continuous vertically depending peripheral rib or edge wall 16 which has a substantial vertical thickness as indicated by the letter a at the approximate transverse center line x—x of the snowshoe and tapers in opposite directions to substantially lesser vertical thickness as indicated by b and c at the rear and forward ends of the snowshoe 18 and 20 respectively, thereby providing a multilevel unit having optimum strength in the weight bearing area of the snowshoe while allowing walking ease.

The lower edges of peripheral rib or edge wall 16 are scalloped as at 17 at each side of the snowshoe approximately centrally of the snowshoe's length, which configuration provides greater side and bottom traction and defines an operating plane engageable with the snow.

A somewhat eliptically shaped through opening 22 is provided in deck 14 and is bounded by a second peripheral rib or edge wall 24 which depends vertically from deck 14 and which has a forward edge 26 spaced slightly rearwardly of snowshoe forward end 20, a pair of opposite side edges 28 and 30 each spaced slightly inwardly of peripheral rib or edge wall 16, and a rearward edge 32 which is positioned approximately at transverse center line x-x.

Side edges 28 and 30 of second peripheral rib or edge wall 24 are provided with aligned, annular, molded hubs 34, each hub having a central opening 36 facing into through opening 22.

A third rib 37 extends rearwardly from rearward edge 32 of opening 22 and depends vertically from deck 14.

Third rib 37 forms somewhat of a half elipse and is spaced inwardly from and follows the contour of rib or edge wall 16.

The trio of ribs 16, 24 and 37 provide added traction.

The upper surface of deck 14 is relieved to provide a depression 39 which extends rearwardly from rearward edge 32 of opening 22.

Depression 39, which follows the contour of and is supported by third rib 37, provides a space for the rearward portion of the boot of a user.

Portions of deck 14 are cut away as at 41 adjacent each side edge of the snowshoe in the area between depression 39 and rib 16 for weight reduction purposes.

A unique binding, pivot means is generally indicated by 38 and is mounted for pivotal movement in opening 22.

Binding, pivot means 38 includes a two-part axle 40, a binding 42 and a crampon 44 all joined together as a unit to provide strength and rigidity.

Two-part axle 40 is best seen in FIGS. 12–17 and includes a pair of identical half-parts 46*a* and 46*b* molded from any strong, high impact material such as thermosetting, polyurethane elastomer.

Each axle half-part 46*a* and 46*b* comprises a flat body 48 somewhat triangulate in plan having spaced parallel end walls 50 and 52 and spaced forward and rearward walls 54 and 56 respectively.

End walls 50 and 52 each form a right angle with forward wall 54, while rearward wall 56 forms a part triangle with walls 50 and 52.

The lower face of body 48 of each half part is undercut or relieved for approximately one-half the thickness of body 48 to provide a substantially rectangular recess 58 which extends between forward wall 54 and rearward wall 56 and has an inner wall 58' which is parallel to end wall 52.

Each half part 46*a* and 46*b* is provided with an integral bearing or annular boss 60 which extends horizontally outwardly from end wall 50 and is also provided with a pair of openings 62 and 64 which extend vertically through the half part.

Each opening 62 is located approximately centrally of body 48 and each opening 64 is located approximately centrally of recess 58 adjacent rearward wall 56.

In use, one half part 46*a* or 46*b* is inverted relative to the other and the half parts are brought into face-to-face relationship with the recess 58 of one half part mating with the recess 58 of the other half part with end walls 52 of each half part engaging each inner wall 58' of recesses 58 to form integral axle 40, with the openings 62 of each half part being axially aligned with each other and the openings 64 also being aligned with each other.

Integral bearings or bosses 60 are of appropriate size as to be snugly receivable in openings 36 of molded hubs 34 provided on side edges 28 and 30 of second rib or edge wall 24.

Hubs 34 are so positioned that axle 40 is located in close proximity to the lower scalloped edge 17 of peripheral rib 16 of the deck which defines the operating plane between the snowshoe and the snow.

Binding 42 is provided with a trio of openings 62*a* and 64*a* which extend vertically therethrough, and crampon 44 is provided with a trio of openings 62*b* and 64*b* which extend vertically therethrough, all of said openings being placed in a triangulate configuration and being located so as to be aligned with openings 62 and 64 in two-part axle 40, whereby, when the trio of binding 42, two-part axle 40 and crampon 44 are placed in a stacked relationship, all of the openings are vertically aligned and the binding, axle and crampon may be joined together as an integral unit by any suitable means such as by bolts or screws 66 which extend downwardly through the openings and are secured by nuts 68.

Binding 42 is fabricated from a thin, flat, durable, resilient plastic material such as polyether-ester block copolymer, for easy deformation and attachment to the boot of a user and includes a transversely extending main body portion 70 through which openings 62*a* and 64*a* extend, a pair of laterally spaced wing-like extensions 72 and 74 which extend rearwardly and outwardly from the rear edge of the main body portion 70, and a pair of vertically spaced, substantially parallel finger-like extensions 76 and 78 which extend laterally outwardly from a side edge of the main body portion.

One end of a toe strap 80 is fixed as by rivets 82 to binding 42 and extends laterally outwardly and forwardly from a forward side edge of main body portion 70.

The free end of toe strap 80 may be slidably engaged in a spring actuated, cam lock buckle 84 which is mounted on a strap 86 which extends between finger-like extensions 76 and 78 and is fixed at one end as by rivets 88 to finger-like extension 76 and is fixed at its opposite end as by rivets 90 to finger-like extension 78.

Figure 20:
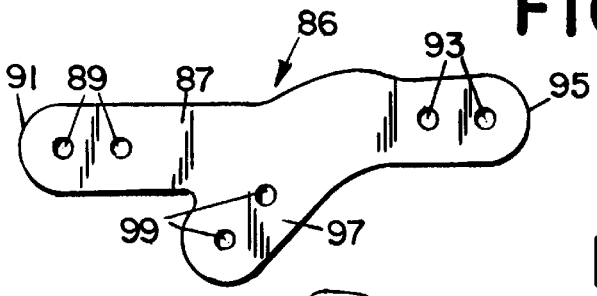
FIG. 20 is a top plan view of the Y strap toe buckle holder of the Molded Snowshoe of the invention, the Y strap being shown in a flat or non-use position.
Figure 21:
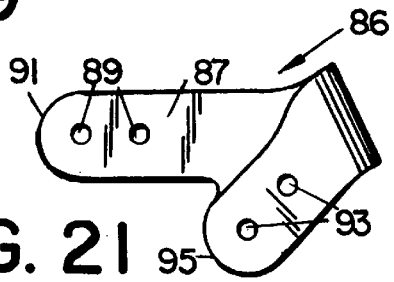
FIG. 21 is a top plan view of the Y strap of FIG. 20 shown in a folded or use position.

As best seen in FIGS. 20 and 21, strap 86 has a configuration in plan somewhat resembling the letter Y and includes a substantially rectangular main body portion 87 provided on its central longitudinal axis with a pair of aligned, spaced openings 89 adjacent one of its ends 91, and a pair of aligned spaced openings 93 adjacent its opposite end 95.

An integral, finger-like protrusion 97 extends angularly outwardly from one side edge of main body portion 87.

Protrusion 97 is provided with a pair of spaced aligned openings 99 on its central longitudinal axis.

In use, end 95 of strap 86 is inserted through an opening in cam lock buckle 84 and end 95 is bent over a cross bar of the buckle and its face is brought into contact with the face of protrusion 97 whereby openings 93 of end 95 are now aligned with openings 99 of protrusion 97.

Strap 86 is now fixed to binding 42 with rivets 88 passing through openings 93 and 99 in strap 86 and through provided openings in finger like extension 76 of the binding and with rivets 90 passing through openings 89 in strap 86 and through provided openings in finger like extension 78 of binding 42.

By this arrangement, strap 86 is anchored at both ends, and buckle 84 is firmly anchored to the strap.

One end of a heel strap 92 is fixed to a rear edge of wing-like extension 74 as by rivets 94 and extends laterally rearwardly therefrom.

The free end of heel strap 92 may be slidably engaged in a spring actuated, cam lock buckle 96 which is fixed at one of its ends to a rear edge of wing-like extension 72 as by rivets 98 and extends laterally rearwardly therefrom.

A plurality of anti-slip pins or cones 98 and a positioning rib 100 extend upwardly from the upper face of main body portion 70 of binding 42 and are formed integrally therewith.

Positioning rib 100 is located approximately centrally of main body portion 70 and serves as a locating point for the proper positioning of the ball of the foot of a user, while anti-slip pins 98 provide stability and preclude sliding of a boot relative to the binding.

Portions of wing-like extensions 72 and 74 are cut away or relieved as at 102 to reduce the weight of binding 42.

A plurality of anti-slip pins 104 is provided on the upper faces of wing-like extensions 72 and 74, on finger-like extensions 76, and on main body portion 70 of binding 42 and are formed integrally therewith.

Anti-slip pins 104 are added to the molding to increase the friction between a boot and the binding. Many parents purchase boots a few sizes too big so that a child may use them for more than one year. This means that in many cases the boot is somewhat limber and difficult to tighten. The anti-slip pins 104 on the binding enhance its grip on the boot.

Figure 10:
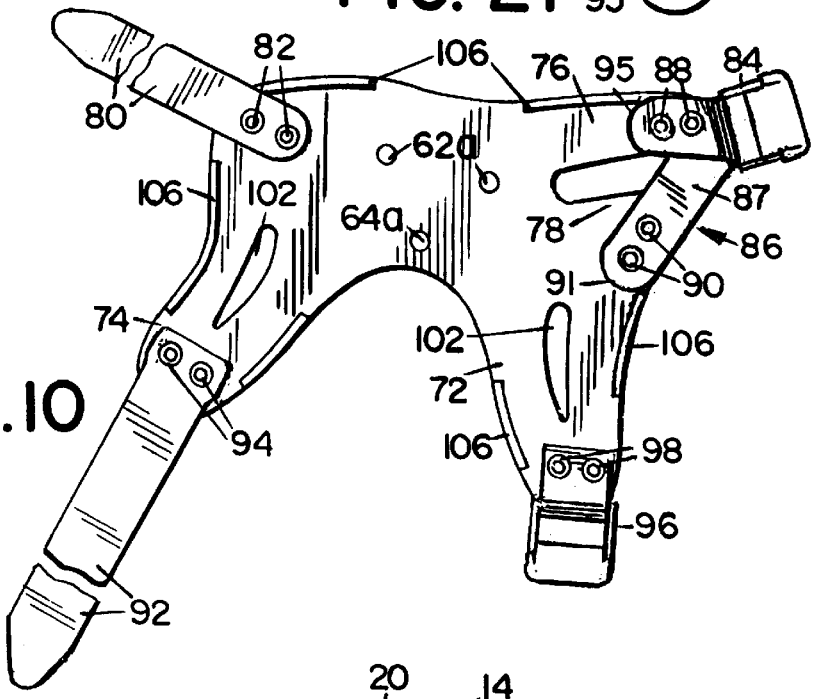
FIG. 10 is a bottom plan view of the left foot snowshoe binding of FIG. 7.
Figure 11:
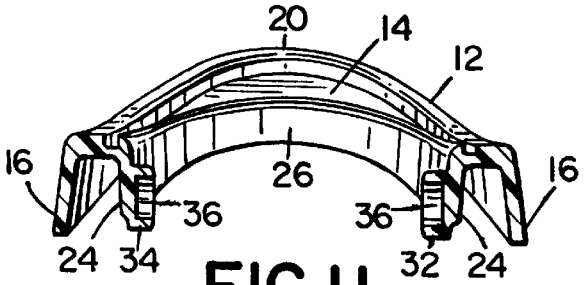
FIG. 11 is a cross sectional view taken on line 11—11 of FIG. 4.
Figure 12:
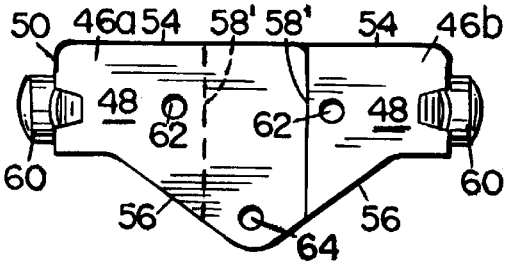
FIG. 12 is a top plan view of the two-part axle of the Molded Snowshoe of FIG. 1.
Figure 13:
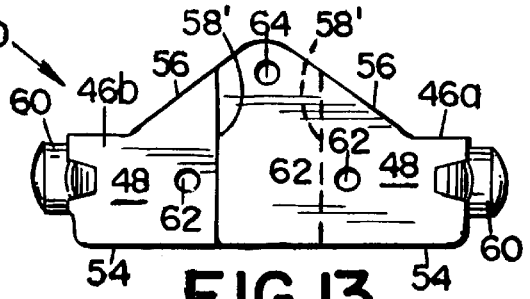
FIG. 13 a bottom plan view of the two-part axle of FIG. 12.
Figure 14:
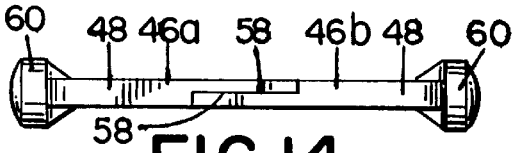
FIG. 14 is a front elevational view of the two-part axle of FIG. 12.
Figure 15:
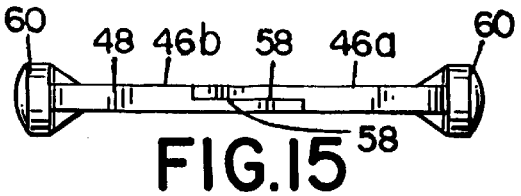
FIG. 15 is a front elevational view of the two-part axle of FIG. 13.
Figure 16:
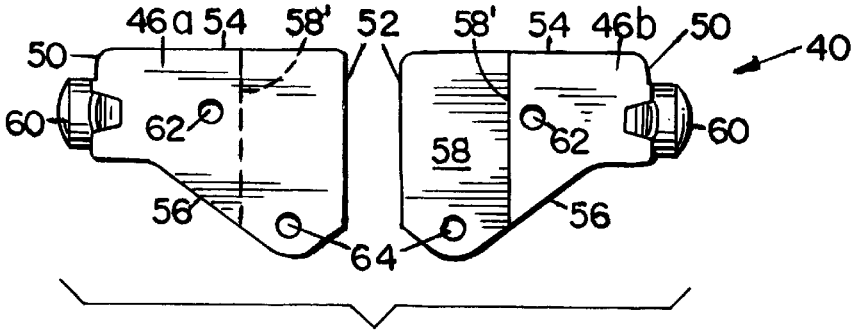
FIG. 16 is an exploded top plan view of the two-part axle of FIG. 12.
Figure 17:
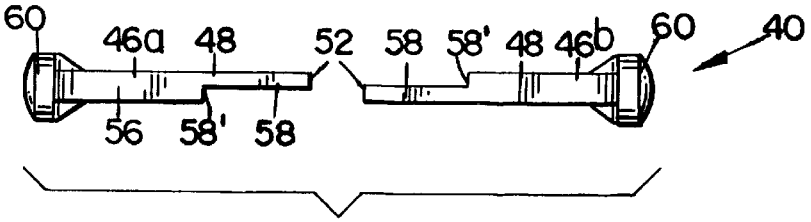
FIG. 17 is an exploded front elevational view of the two-part axle of FIG. 16.

As best seen in FIG. 10, a plurality of reinforcing ribs 106 are strategically placed on the lower face of binding 42 to add strength to the binding and also to force the binding to bend at specific locations for proper fit to a boot, rather than randomly.

Figure 8:
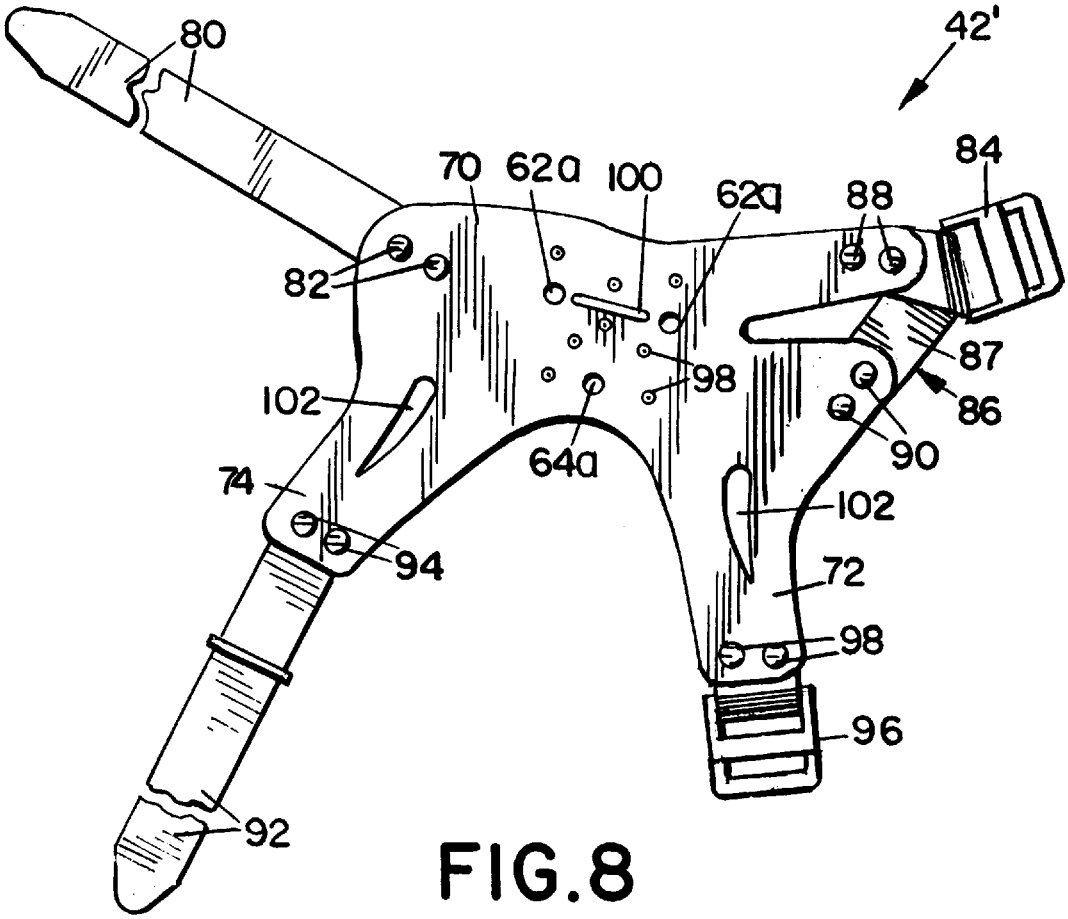
FIG. 8 is a top plan view of a modified right foot binding for use with the Molded Snowshoe of the invention.
Figure 9:
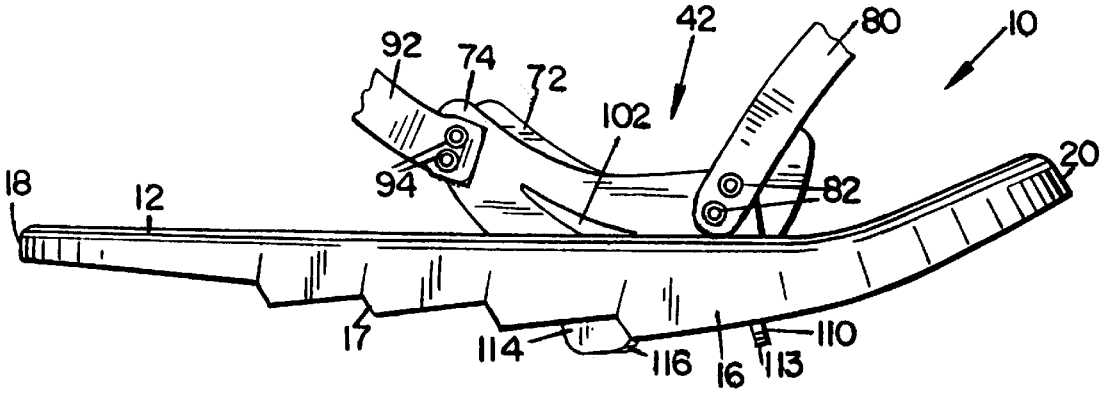
FIG. 9 is a rear elevational view of the Molded Snowshoe of FIG. 1.

A modified form of binding 421 shown in FIG. 8 is molded without anti-slip pins. Binding 42' is otherwise asymmetrically identical to binding 42, and is used for the right foot of the user.

Figure 18:
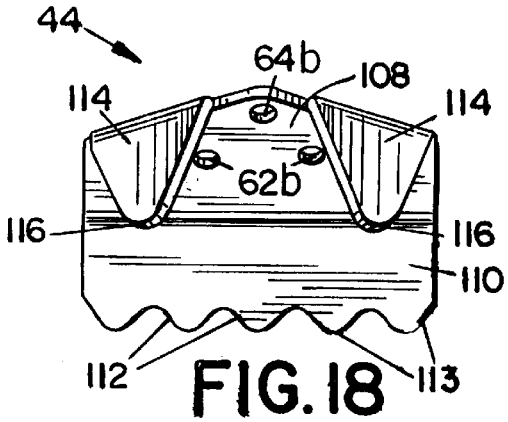
FIG. 18 is a bottom perspective view of the crampon of the Molded Snowshoe of the invention.
Figure 19:
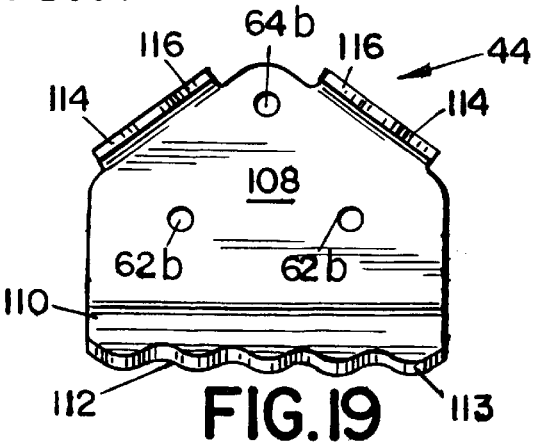
FIG. 19 is a bottom plan view of the crampon of FIG. 18.

Crampon 44, best seen in FIGS. 18 and 19, is preferably fabricated from a strong metal such as stainless steel and has a horizontally-extending main body portion 108 which is somewhat triangular in top plan so as to conform to the shape of two-part axle 40 when it is disposed on the top surface of the latter.

Openings 62*b* and 64*b* in crampon 44 extend through main body portion 108 and allow the passage therethrough of bolts or screws 66.

The forward edge of crampon 44 is bent downwardly to form a lip 110 having a series of spaced serrations or teeth 112 rounded at their lower free ends as at 113, such rounded surfaces dimishing the risk of children being cut by sharp, pointed teeth.

The rearward edge of crampon 44 is provided with a pair of spaced, downwardly extending teeth 114 rounded at their free ends as at 116.

The lower free ends of serrations 112 and teeth 114 are rounded as opposed to being pointed to promote child safety and extend approximately one-quarter inch below the plane of rib or edge wall 16 so that the user may safely walk on ice.

We claim:

1. A snowshoe for traversing over snow comprising, an integral deck and frame molded from a high impact, plastic material, the deck having multiple levels, the deck and frame having a peripheral rib depending therefrom, the peripheral rib having a contoured lower surface which defines an operating plane engageable with the snow, the peripheral rib having a substantial vertical thickness centrally of its length and tapering therefrom in opposite directions to substantially lesser vertical thicknesses at its opposite ends, the deck having a central opening therein, a binding pivot system mounted for pivotal movement relative to said central opening, the binding pivot system including an axle molded from a pair of identical half-parts, each half-part having upper and lower planar faces and an integral bearing, the lower planar faces each being provided with identical recesses whereby when one half-part is inverted relative to the other and the recesses are brought into face-to-face relation and secured to each other, a unitary axle is formed, the bearings of the half-part being journalled in hubs which are molded integrally with the deck and frame and extend into said central opening, the hubs being so positioned that the axle is located in close proximity to the operating plane between the snowshoe and the snow.

2. A snowshoe according to claim 1, including a binding having integral non-slip means thereon, and a crampon fixed to the axle and moveable therewith, the binding including a toe strap engageable with a first spring activated cam lock buckle, the buckle being mounted on a Y strap fixed to the binding and a heel strap engageable with a second spring actuated cam lock buckle fixed to the binding.

* * * * *